US006339849B1

(12) United States Patent
Nelson et al.

(10) Patent No.: US 6,339,849 B1
(45) Date of Patent: Jan. 22, 2002

(54) SOCCER HELMET

(76) Inventors: Keith J. Nelson, 1417 Sumac Dr., Logan, UT (US) 84321; Ronald A. Carter, 827 N. 900 East, Bountiful, UT (US) 84054

( * ) Notice: Subject to any disclaimer, the term of this patent is extended or adjusted under 35 U.S.C. 154(b) by 0 days.

(21) Appl. No.: 09/311,538

(22) Filed: May 13, 1999

(51) Int. Cl.[7] ..... A42B 3/00
(52) U.S. Cl. ..... 2/425; 2/411
(58) Field of Search ..... 2/410, 411, 414, 2/425, 417, 421, 412

(56) References Cited

U.S. PATENT DOCUMENTS

| | | | | | |
|---|---|---|---|---|---|
| 2,969,547 | A | * | 1/1961 | Dye | 2/411 |
| 3,925,821 | A | | 12/1975 | Lewicki | 2/3 R |
| 4,058,854 | A | * | 11/1977 | Rhee | 2/412 |
| 4,404,690 | A | * | 9/1983 | Farquharson | 2/420 |
| 4,443,891 | A | * | 4/1984 | Blomgren et al. | 2/414 |
| 4,477,929 | A | * | 10/1984 | Mattsson | 2/425 |
| 4,698,852 | A | | 10/1987 | Romero | 2/171 |
| 4,903,348 | A | | 2/1990 | Broersma | 2/421 |
| 4,912,777 | A | | 4/1990 | Gasbarro | 2/2.1 R |
| 5,056,162 | A | * | 10/1991 | Tirums | 2/412 |
| 5,177,815 | A | * | 1/1993 | Andujar | 2/411 |
| 5,226,180 | A | * | 7/1993 | Leach | 2/411 |
| 5,271,103 | A | * | 12/1993 | Darnell | 2/418 |

(List continued on next page.)

OTHER PUBLICATIONS

Anonymous, "A Safer Way to "Head" a Soccer Ball," *Child Health Alert*, vol. 13, p. 5, Sep. 1995.

Anonymous, "Injuries Associated with Soccer Goalposts—United States, 1979–1993," *JAMA, The Journal of American Medical Association*, vol. 271, No. 16, p.1233–1234, Apr. 27, 1994.

Boden, Barry P., et al., "Concussion Incidence in Elite College Soccer Players," *The American Journal of Sports Medicine*, vol. 26, No. 2, pp. 238–241, 1998.

Dailey, Stephen W., MD, and William G. Barsan, MD, "Head Injuries in Soccer. A Case for Protective Headgear?" *The Physician and Sportsmedicine*, vol. 20, No. 8, pp. 79–82, 85, Aug. 1992.

Jordan, Sheldon E., "Acute and Chronic Brain Injury in United States National Team Soccer Players," *The American Journal of Sports Medicine*, vol. 24, No. 2, pp. 205–210, 1996.

Maehlum, S., MD, and O.A. Daljord, MD, "Football Injuries in Oslo: A One–Year Study," *Brit. Journal of Sports Medicine*, vol. 18, No. 3, pp. 186–190, Sep. 1984.

(List continued on next page.)

*Primary Examiner*—Michael A. Neas

(57) ABSTRACT

A soccer helmet includes a generally dome-shaped padding layer and a generally dome-shaped shell layer fitting over and attached to the padding layer. The padding layer might have a substantially uniform thickness of approximately ⅜ inches. The shell layer is smooth and has some rigidity such that when the soccer helmet is being worn on a human head, the ball rebounds from the shell layer in about the same direction and with about the same speed, or with a greater speed, than the soccer ball would if rebounded off an unprotected human head. Therefore, the soccer helmet does not interfere with heading a soccer ball. The soccer helmet protects the head from repetitive blows due to, for example, heading. Furthermore, the soccer helmet protects the head from single event injuries such as collisions with goal posts, the ground, and other players' head, knee, elbows, and feet.

13 Claims, 3 Drawing Sheets

U.S. PATENT DOCUMENTS

| | | | | | |
|---|---|---|---|---|---|
| 5,461,730 | A | * | 10/1995 | Carrington | 2/411 |
| 5,572,749 | A | | 11/1996 | Ogden | 2/421 |
| 5,930,841 | A | * | 8/1999 | Lampe et al. | 2/411 |
| 6,065,159 | A | * | 5/2000 | Hirsh | 2/425 |

OTHER PUBLICATIONS

Mandel, Steven, MD, "Minor Head Injury May Not Be Minor," *Postgraduate Medicine*, vol. 85, No. 6, pp. 213–217, 220, and 225, May 1, 1989.

Smodlaka, Vojin N., MD, ScD, "Medical Aspects of Heading the Ball in Soccer," *The Physician and Sportsmedicine*, vol. 12, No. 2, pp. 127, 131, Feb. 1984.

Sortland, O., and A.T. Tysvaer, "Brain Damage in Former Association Football Players. An Evaluation by Cerebral Computed Tomography, " *Neuroradiology*, vol. 31, pp. 44–48, Feb. 22, 1988.

Tysvaer, A, and O. Storli, "Association Football Injuries to the Brain. A Preliminary Report," *Brit. Journal of Sports Medicine*, vol. 15, No.3, pp. 163–166, Sep. 1981.

Tysvaer, AlfT., MD, and Odd–Vebjørn Sorli, MD, "Soccer Injuries to the Brain. A Neurologic and Electroencephalographic Study of Active Football Players," *The American Journal of Sports Medicine*, vol. 17, No. 4, pp. 573–577, 1989.

Tysvaer, AlfT., MD, and Einar A. Løchen, PhD, "Soccer Injuries to the Brain. A Neuropsychologic Study of Former Soccer Players," *The American Journal of Sports Medicine*, vol. 19, No. 1, pp. 56–60, 1991.

* cited by examiner

SOCCER HELMET

BACKGROUND OF THE INVENTION

1. The Field of the Invention

The present invention relates to apparel. Specifically, the present invention relates to a soccer helmet and method.

2. The Prior State of the Art

Soccer (also called "football") is one of the world's most popular sports. Like many rigorous activities, soccer involves risk of injury, including head injury. Obvious causes of head injury in soccer include head collisions with another player's head, elbow, knee, foot, and so forth. Head injuries may also occur when the head collides into a goal post or when the player falls head first onto the ground. More often than once thought, these types of injuries can result in "concussions." It is well documented in the literature the potential short term and long term effects of single event concussions and multiple concussions.

A less obvious, but apparently real, cause of head injury in soccer is the repetitive use of the head to direct a soccer ball in what is typically called a "header". Several studies have shown that heading can cause minor cumulative brain damage. Soccer players who repeatedly headed the ball during their careers were found to have chronic changes on the electroencephalograms (EEGs) similar to the changes found in amateur boxers. These players were found to have chronic mild to severe deficits in attention, concentration, memory, and judgement. Children who had less experience heading the soccer ball were found to have greater changes in the EEGs.

Such head injuries, even if minor, can have a serious impact on the quality of life. Nearly every aspect of living can be affected. Cognitive symptoms of head injury include difficulty in processing information, shortened attention span, inability to understand abstract concepts, impaired decision-making ability, inability to shift mental tasks or to follow multi-step directions, memory loss or impairment, and language deficits. Perceptual symptoms include change in vision, hearing or sense of touch; loss of sense of time and space and spatial disorientation; disorders of smell and taste; altered sense of balance; and increased pain sensitivity. Physical symptoms include persistent headaches; extreme mental and/or physical fatigue; disorders of movement; seizure activity; impaired small motor control; photosensitivity; sleep disorders; paralysis; and speech that is not clear due to poor control of the muscles in the lips, tongue and jaw and/or poor breathing patterns. Behavioral and emotional symptoms include irritability; impatience; reduced tolerance for stress; lack of initiative; dependence; failure to assume responsibility for one's actions; denial of disability; lack of inhibition; inflexibility; and flattened or heightened emotional reactions. Needless to say, the effect of head injury on the quality of life is far reaching.

While the number of individuals participating in soccer is too difficult to ascertain precisely, estimates made in the early 1980s have it that there were more than 22 million amateur participants. Currently, this number may be closer to 40 million or more participants considering the increased popularity of soccer during the 1990s. Thus, considering the immense number of individuals participating in soccer worldwide, and considering the potential wide-ranging effect of head injury on the quality of life, even a slight risk of head injury in soccer has great impact upon individual health as well as world health.

A head guard aimed at providing a limited degree of head protection in soccer is described in U.S. Pat. No. 4,698,852 issued to Romero on Oct. 13, 1987. The Romero device includes a resilient, rectangular contact portion for contacting and absorbing perspiration from the player's forehead, and a corresponding outer layer for frictionally contacting the soccer ball.

The Romero device aims to protect the forehead from minor tearing and breaking of capillaries in the skin of the forehead. The Romero device does not disclose that it protects against more serious injuries such as repetitive or single event brain injuries or concussions. Furthermore, although a proper header is performed by striking the forehead against the ball, such headers are not always possible due to the inexperience of the player or due to the heat of competition. Some evidence shows that these types of improper headers give rise to a higher risk of head injury. Thus, the Romero device does not provide consistent head protection, and provides no head protection for higher risk headers in which the soccer ball impacts with areas other than the forehead. Furthermore, areas other than the forehead are left exposed to acute injury such as that resulting from head collisions with other players or objects.

From a performance standpoint, the Romero device also might actually interfere with heading if the soccer ball hits the edge of the rectangular pad, rather than its center. The abrupt edge could rebound the soccer ball in a direction much different than if the soccer ball rebounded off a smoother surface such as an unprotected head.

Helmets have conventionally been used in most sports which involve a risk of head injury such as American football, baseball, ice hockey, lacrosse, cycling, skiing, snowboarding, kayaking, equestrian sports, and rock climbing. However, conventional helmets would seriously interfere with heading and thus interfere with the very nature of the sport of soccer. Conventional helmets have not been seriously considered for use in soccer despite the relatively new awareness of the potential of acute and chronic problems from head injuries in soccer.

Therefore, an apparatus and method are desired for providing more comprehensive protection to a soccer player's head without interfering with heading.

SUMMARY OF THE INVENTION

In accordance with the present invention, a soccer helmet includes a generally dome-shaped padding layer and a generally dome-shaped shell layer fitting over and attached to the padding layer. The padding layer might have a substantially uniform thickness of approximately ⅜ inches. The shell layer is smooth and has some rigidity such that, when the soccer helmet is being worn on a human head, a soccer ball will rebound from the shell layer in substantially the same direction, and with substantially the same speed, or with greater speed, as the ball would if rebounded off an unprotected head. Therefore, the soccer helmet does not interfere with a header. A high friction material or finish may be disposed on the forehead portion of the shell layer to allow for better control over the soccer ball.

A soccer helmet padding layer may be formed with a uniform thickness at an area corresponding to a human forehead. The thickness of the padding layer in other areas may vary according to the user's preference. Furthermore, the padding layer may include channels on the inside surface to ventilate and control perspiration from a player's head. A soccer helmet shell layer formed to fit over the soccer helmet padding layer is attached to the soccer helmet padding layer. The soccer helmet padding layer may be removed from the soccer helmet shell layer without damage to either the padding layer or shell layer.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The invention is described below by using diagrams to illustrate an embodiment of the present invention. Using the diagrams in this manner to present the invention should not be construed as limiting of its scope.

Figure 1:
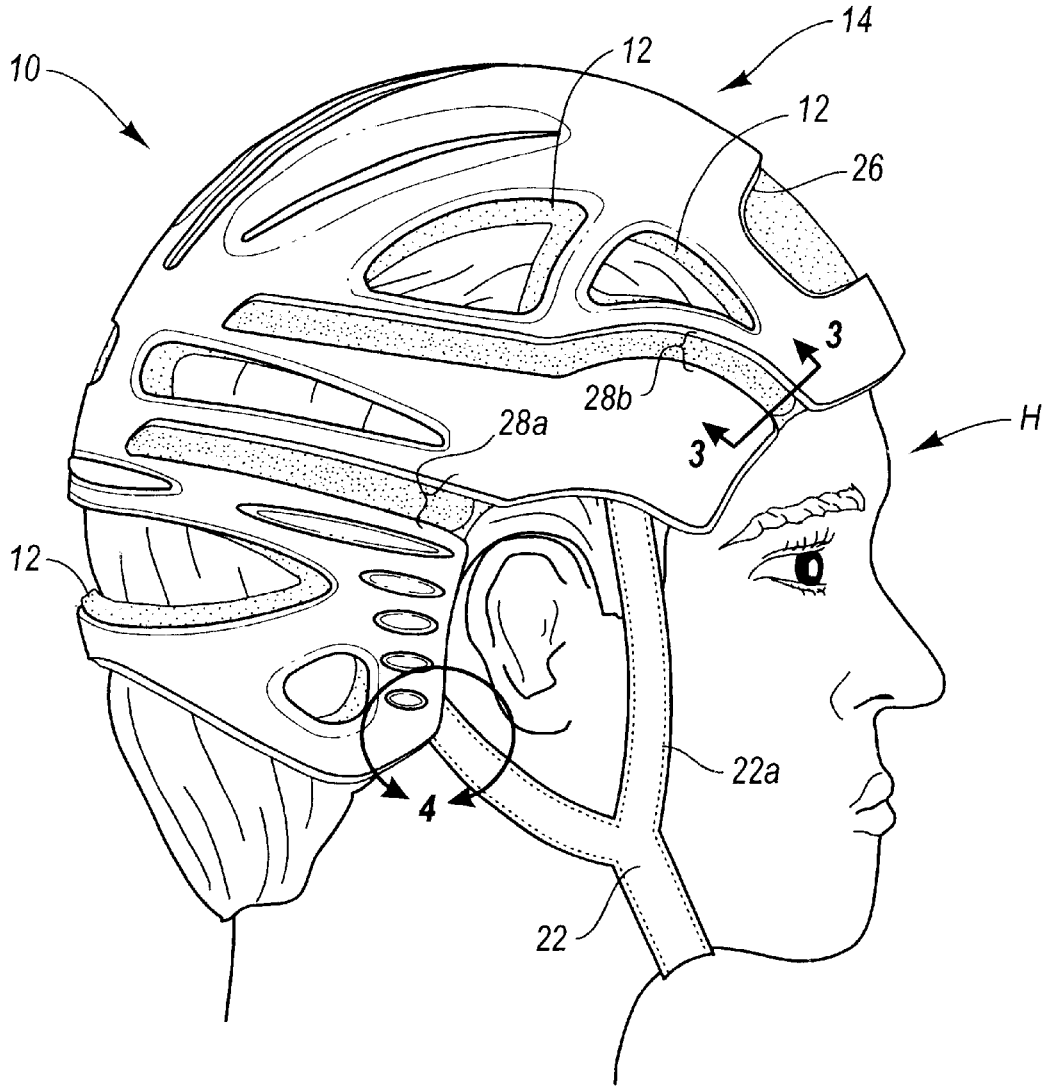
FIG. 1 shows a soccer helmet in accordance with the invention secured to a human head.

Referring to FIG. 1, a soccer helmet 10 is secured to a human head (H) using a chin strap 22. A dome-shaped outer shell layer 14 embraces a dome-shaped padding layer 12, the padding layer 12 substantially fitting over and conforming to the shape of the cranium of the human head (H). Thus, the shell layer 14 and padding layer 12 distribute focused mechanical shocks received by the shell layer 14 thereby protecting the human head (H). The surface of the shell layer 14 is substantially smooth without significant protrusions that might affect the rebound direction of the soccer ball. Furthermore, the dome-shaped shell layer 14 is sufficiently rigid and resilient, when worn on the human head (H), that the shell layer 14 rebounds the ball with about the same speed, or with greater speed, than the ball would rebound if off an unprotected head. The thickness and material of the shell layer 14 and padding layer 12 are chosen as described below to balance head protection (e.g., energy absorption properties) against performance (rebound direction and resiliency) such that the soccer helmet protects the head without significantly interfering with heading.

Figure 2:
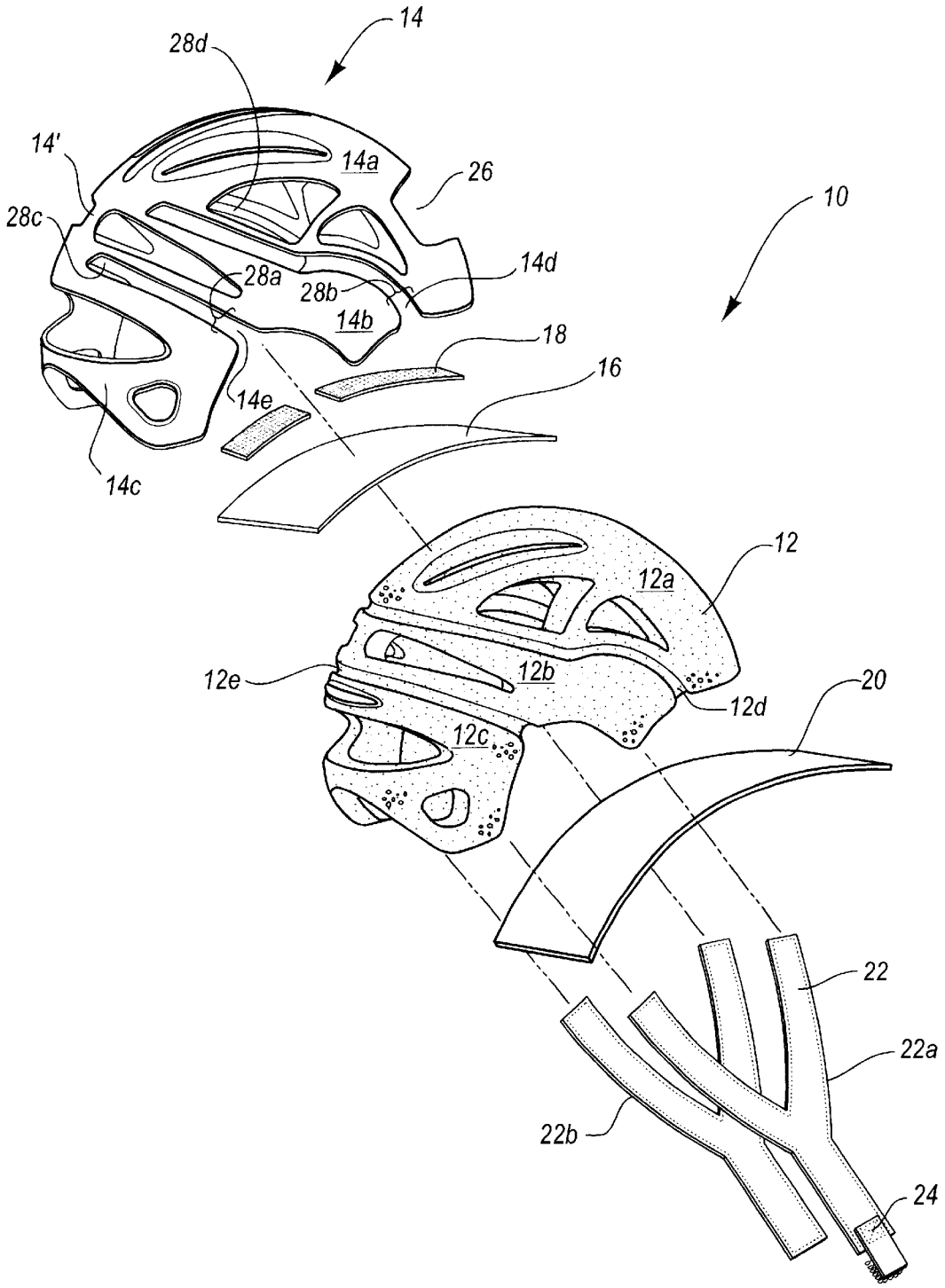
FIG. 2 is an exploded view of the soccer helmet of FIG. 1.

The various components of the soccer helmet 10 are now described in further detail with respect to FIG. 2 which shows the soccer helmet 10 in exploded view. The padding layer 12 in the center of FIG. 2 is composed of, for example, a closed-cell foam such as Volara™ closed-cell polyolefin foam supplied by Voltek, a division of Sekisui America Corporation, located in Lawrence, Mass. The polyolefin foam making up the padding layer 12 preferably has a substantially uniform thickness of approximately ⅜ inches. Although the padding layer 12 covers the entire cranium, the portion of uniform thickness may apply over the forehead only, over the forehead and crown only, or over the entire cranium. The choice of thickness of the padding layer 12 given a certain material is obtained by balancing two competing factors. On the one hand, the thicker the padding layer 12, the more energy the padding layer 12 absorbs, and the more protection there is for the human head (H). On the other hand, the thinner the padding layer 12, the more natural the feel of the header. A thickness of approximately ⅜ inches provides one balance of these competing factors for polyolefin foam. However, the thickness may range from 3⁄16 inches or less to ⅞ inches or more depending on the user's preference, the desired level of protection and/or performance, and on the padding material used.

The padding layer 12 includes a major dome-shaped portion 12*a* that covers the forehead, temples and crown of the human head (H). A minor arcuate portion 12*c* covers the rearward portion (e.g., lower parietal region and/or upper neck) of the human head (H). A second minor arcuate portion 12*b* covers a portion of the human head (H) between the major dome-shaped portion 12*a* and the first minor arcuate portion 12*c*. Indentations 12*d*, 12*e* in the padding layer 12 are provided between the portions 12*a*, 12*b*, 12*c* of the padding layer 12. Alternatively, a fabric or other compressible medium connects the portions 12*a*, 12*b*, 12*c*. The shape of the padding layer 12 shown in FIG. 2 is obtained by a molding process such that the assembled padding layer 12 conforms generally to the shape of the human head (H). Padding layer 12 may also have channels formed in the surface facing the human head (H) so as to ventilate and control perspiration from the human head (H).

The dome-shaped shell layer 14 is substantially the same shape as the padding layer 12 so as to fit over the padding layer 12. The dome-shaped shell layer 14 is composed of a thin layer of plastic such as a 0.090 inch thick layer of polypropylene. Alternatively, the plastic material may be fiber reinforced. The choice of material and thickness depends on two competing factors. If the shell layer 14 is too rigid, the soccer ball will be difficult to control and the shell layer 14 will not be flexible enough to fit a wide range of head sizes as described below. If the shell layer 14 is too soft, the soccer ball will rebound slower than off an unprotected head. The material and dimensions of the shell layer 14 (namely, a 0.090 inch thick layer of polypropylene) described above are just one balance of these competing factors. Other materials and thicknesses may be used according to the user's preference for control, flexibility, and rebound speed.

The dome-shaped shell layer 14 also has a major dome-shaped portion 14*a* and two minor arcuate portions 14*b*, 14*c* corresponding to the portions 12*a*, 12*b*, 12*c*, respectively, of the padding layer 12. Slots 14*d*, 14*e* corresponding to the indentations 12*d*, 12*e* in the padding layer 12 separate portions 14*a*, 14*b*, 14*c* of the shell layer 14 except at the center region 14'. Flexible tabs 28*a*, 28*c* connect the minor arcuate portions 14*b*, 14*c* of the shell layer 14 over the slot 14*e*. Flexible tabs 28*b*, 28*d* connect the minor arcuate portion 14*b* of the shell layer 14 to the major portion 14*a* of the shell layer 14 over the slot 14*d*. The shell layer 14 shown in FIGS. 1 and 2 may be formed by, for example, injection molding.

The configuration of the dome-shaped shell layer 14 permits the soccer helmet 10 to accommodate a wide range of head sizes and shapes. For example, the soccer helmet 10 is flexible side-to-side, crown-to-back, and circumferentially.

The minor arcuate portions 14*b,* 14*c* of the shell layer 14 are flexible allowing their radius of curvature along their major directions (namely, side-to-side) to increase to accommodate wider head shapes. The major portion 14*a* also has some flexibility side-to-side. Thus, the soccer helmet 10 has flexibility side-to-side. The soccer helmet 10 may also be flexed crown-to-back thereby increasing the width of slots 14*d* and 14*e,* and thereby stretching tabs 28. Thus, the soccer helmet 10 has flexibility crown-to-back. The side-to-side and crown-to-back flexibilities of the soccer helmet 10 allow the shell layer 14 to adjust in circumference to the shape of the human head (H). The restoring force of the shell layer 14 causes the soccer helmet 10 to hug the human head (H). Thus, the soccer helmet 10 maintains its position even after heading a soccer ball and does not need to be adjusted very often, if at all, during soccer play.

The shell layer 14 and padding layer 12 have numerous ventilation holes formed therein as shown in FIG. 1 to allow for heat and moisture dissipation. Even with the ventilation holes, the soccer helmet 10 still provides significant protection in the areas having the ventilation holes. However, the areas of the soccer helmet 10 covering the crown, forehead and temples of the human head (H) lack ventilation holes thereby maximizing protection for areas subject to a higher risk of injury. The shell layer 14 is high enough over the ear that the ear does not contact the shell layer 14 during normal soccer play. A large wide hole in the minor arcuate portions 12*c,* 14*c* of the padding layer 12 and shell layer 14 allows a pony tail to extend through the back of the soccer helmet 10.

Although shell layer 14 and padding layer 12 have ventilation holes or indentations, these holes or indentations are not large enough to significantly affect the rebound direction of the soccer ball. Furthermore, shell layer 14 has no significant protrusions. A "significant" protrusion is defined as a protrusion from a surface that materially affects the rebound direction of the soccer ball. In this description and in the claims, a surface that lacks significant protrusions is termed "smooth" even if the surface has holes that do not materially affect the rebound direction of the soccer ball.

The soccer helmet 10 also includes a means for attaching the shell layer 14 to the padding layer 12. The means may include a permanent attachment means such as adhesion or co-molding the padding layer 12 and shell layer 14 together as a composite material. However, in the embodiment shown in the figures, the shell layer 14 is removably attached to the padding layer 12 allowing the padding layer 12 to be washed or replaced.

Specifically, as seen in FIG. 2, a Velcro™ compatible loop laminate 16 is laminated to the outer surface of the padding layer 12 with the loop side facing the inside surface of the shell layer 14. The loop laminate 16 may be supplied by Veltex Industries, Inc. located in Chino Hills, Calif.

A Velcro™ sheet 18 is adhered to the inside surface of the shell layer 14 with the hook side of the Velcro™ sheet 18 facing the loop side of the loop laminate 16. When the Velcro™ sheet 18 contacts the loop laminate 16, the shell layer 14 is attached to the padding layer 12. However, a reasonable amount of force will detach the Velcro™ sheet 18 from the loop laminate 16 thus detaching the shell layer 14 from the padding layer 12. Thus, the padding layer 12 may be interchangeable with a padding layer having different energy absorption characteristics to fit the user's preferences. For example, a ¼ inch polyolefin foam may replace the ⅜ inch polyolefin foam. The force required to remove the padding layer 12 is greater than that experienced when a soccer ball is headed with the soccer helmet 10, thus preventing detachment during normal soccer play.

The interchangeability of the padding layer 12 allows for great flexibility in balancing safety and performance according to the particular circumstances. A player may opt for a thicker padding layer 12 if safety is more important and/or if performance is less important. For example, if the player is practicing only, it is not as critical that the ball be headed in an optimum fashion. Also, if the ground is wet, the possibility of slipping and injuring the head increases. If the player has already suffered some head injury in the past such as a concussion, the player might want to avoid further injury more than one who has never suffered head injury. If the player is risk averse to injury, the player may want more protection than one who is less concerned about injury. In addition, if the player is a child, the chances of being injured by a header are thought to increase due to, for example, the smaller head size of the child, and due to the child's inexperience with headers. Parents tend to be much more concerned about a child's safety during a soccer match than they are about the child's performance. In these situations, a thicker padding layer 12 may be opted for.

On the other hand, a player may opt for a thinner padding layer 12 if safety is less important and and/or if performance is more important. For example, in playoff competition, it is much more important that a soccer ball be well controlled during a header than it is during practice. Thus, a player may opt for a thicker padding layer 12 during practice, but opt for a thinner padding layer 12 during competition. A single shell layer 14 can accommodate padding layers 12 of a variety of thicknesses for the same reason as the shell layer 14 can accommodate a wide variety of head sizes. Namely, the shell layer 14 can flex to accommodate the various padding layer 12 thicknesses.

Figure 3:
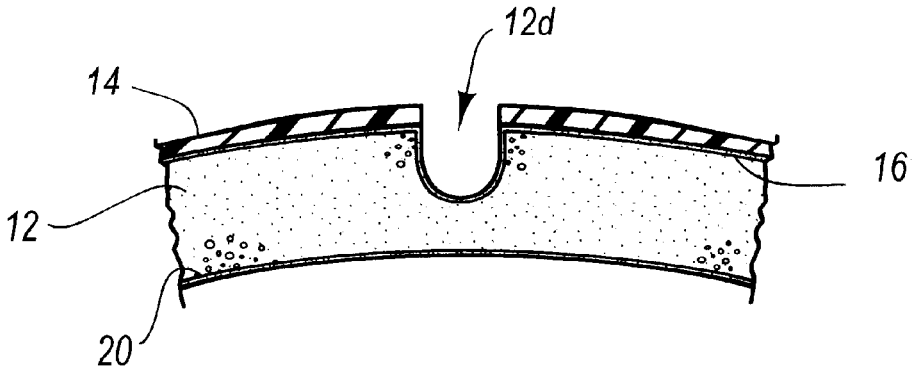
FIG. 3 is a cross-sectional view along cross section line 3—3 of FIG. 1.

A moisture management material 20 is attached to the inside surface of the padding layer 12 by, for example, lamination or adhesion. The moisture management material 20 wicks perspiration from the human head (H) and dissipates heat and may be, for example, Hydrofil Dri-Lex 2000 supplied by Faytex Corporation of Weymouth, Mass. A cross section of the padding layer 12, the shell layer 14, the loop laminate 16 and the moisture management material 20 along cross section line 3—3 of FIG. 1 is shown in FIG. 3. Although the Velcro™ sheet 18 is attached to the loop laminate 16 in some areas, it is not attached in the cross-section 3—3 of FIG. 1.

The moisture management material 20 may extend over the entire cranium from the forehead to the lower parietal region and/or upper neck. However, a sweat band might cover the forehead instead of the moisture management material 20. The sweat band might be removably attached to the shell layer 14.

Figure 4:
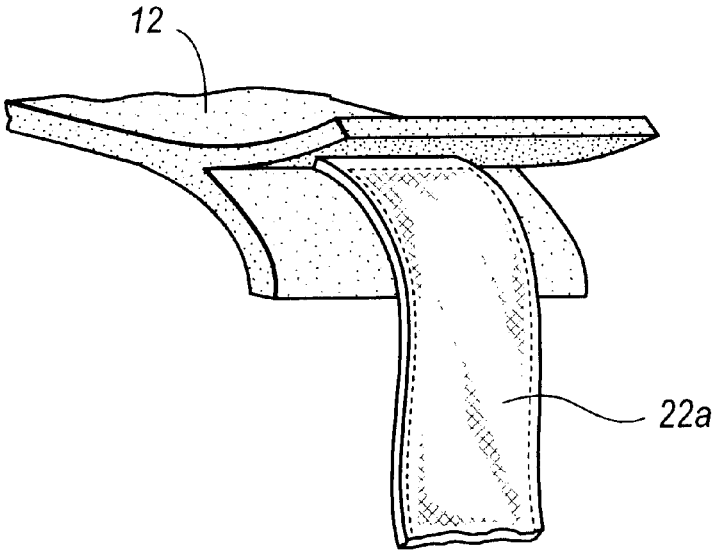
FIG. 4 is a detailed view of portion 4 of FIG. 1 showing the chin strap connected to the padding layer of FIG. 1.

Referring again to FIG. 2, The chin strap 22 has two pieces 22*a,* 22*b,* each having one end attached to either the padding layer 12 or shell layer 14. FIG. 4 is a detailed diagram of portion 4 of FIG. 1 showing an end of the chin strap piece 22*a* sewn to the padding layer 12. Alternatively, the ends of the chin strap pieces 22*a,* 22*b* may be inserted molded with the shell layer 14. The chin strap 22 may be composed of a stretching, form-fitting material such as Lycra or may be a conventional non-stretching material. A Velcro™ piece 24 attaches the other end of the strap pieces 22*a,* 22*b* to each other under the chin thereby securing the soccer helmet 10 to the human head (H).

Referring to FIG. 1, a high friction material or finish 26 may be provided on the forehead portion of the shell layer 14 thus slowing or halting rotation of the soccer ball when contacting the forehead during a header. Thus, the soccer ball may be better controlled.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A soccer helmet comprising:

a generally dome-shaped padding layer having inside and outside surfaces and having a substantially uniform thickness over the forehead region of the human head; and a generally dome-shaped shell layer having inside and outside surfaces, wherein the inside surface of the shell layer is attached to the outside surface of the padding layer, wherein the padding layer and shell layer terminate over the ear so as to leave the ear exposed, wherein the shell layer comprises:

a major portion for covering a forehead and crown of the human head;

a first minor portion for covering a rearward portion of the human head, wherein the major portion is flexibly coupled to the minor portion; and a second minor portion for covering an intermediate portion of the human head between the crown and the rearward portion of the human head, wherein the second minor portion is flexibly coupled to the first minor portion and to the major portion, wherein the first and second minor portions of the generally dome-shaped shell layer define holes, wherein the padding layer defined corresponding holes such that ambient air contacts the human head through the holes when the soccer helmet is worn on the human head.

2. The soccer helmet of claim 1, further comprising:

means for securing the padding layer and shell layer to the human head.

3. The soccer helmet of claim 1, wherein the generally dome-shaped padding layer has a substantially uniform thickness.

4. The soccer helmet of claim 1, wherein the generally dome-shaped padding layer has a thickness of approximately ⅜ inches.

5. The soccer helmet of claim 1, wherein the generally dome-shaped padding layer has a thickness of approximately ⅜ inches at an area corresponding to the temple and crown of the human head.

6. The soccer helmet of claim 1, wherein the first minor portion of the shell layer defines a hole, wherein the padding layer defines a corresponding hole sized such that a pony tail from the human head can fit through the hole.

7. The soccer helmet of claim 1, further comprising means for attaching the generally dome-shaped shell layer to the generally dome-shaped padding layer.

8. The soccer helmet of claim 1, further comprising:

a loop fastener material coupled to one of the shell layer or padding layer; and a hook fastener material coupled to the other of the shell layer or padding layer, wherein the shell layer is attached to the padding layer by contacting the loop fastener material with the hook fastener material.

9. The soccer helmet of claim 1, further comprising a chin strap coupled to one of the padding layer or shell layer for securing the padding layer and shell layer to the human head when the soccer helmet is worn on the human head.

10. The soccer helmet of claim 1, wherein the padding layer is removably and selectively attached to the shell layer.

11. The soccer helmet of claim 1, wherein the padding layer comprises closed cell foam.

12. The soccer helmet of claim 1, wherein the outer surface of the shell layer is smooth at an area corresponding to a human forehead.

13. A soccer helmet comprising:

a generally dome-shaped padding layer having inside and outside surfaces and having a substantially uniform thickness over the forehead region of the human head; and a generally dome-shaped shell layer having inside and outside surfaces, wherein the inside surface of the shell layer is attached to the outside surface of the padding layer, wherein the padding layer and shell layer terminate over the ear so as to leave the ear exposed, and wherein the shell layer is composed of a flexible material that allows the shell layer to fit a wide range of head sizes and has the approximate flexibility of a 0.090 inch thick layer of polypropylene.

* * * * *